US005160566A

United States Patent [19]

Ashby et al.

[11] Patent Number: 5,160,566

[45] Date of Patent: Nov. 3, 1992

[54] DECORATIVE GLASS BLOCK

[76] Inventors: Michael L. Ashby; Clifford T. Ashby, both of 81 Skymountain Cir., Chico, Calif. 95928

[21] Appl. No.: 703,801

[22] Filed: May 21, 1991

[51] Int. Cl.[5] ..... E04C 1/42

[52] U.S. Cl. ..... 156/252; 52/306; 65/58; 156/293; 428/13; 428/34.4

[58] Field of Search ..... 428/13, 34.4; 52/307, 52/306; 156/303.1, 293, 252; 65/42, 58

[56] References Cited

U.S. PATENT DOCUMENTS

| | | | |
|---|---|---|---|
| 595,485 | 12/1897 | Lamb | 428/49 X |
| 2,167,764 | 8/1939 | Lytle | 52/307 |
| 3,330,079 | 7/1967 | Mitchell et al. | 52/307 X |
| 3,629,045 | 12/1971 | Dopera | 428/34.6 |
| 4,172,547 | 10/1979 | Del Grande | 428/38 X |
| 4,277,139 | 7/1981 | Cox | 428/13 X |
| 4,703,574 | 11/1987 | Garjian | 40/543 |

FOREIGN PATENT DOCUMENTS

| | | | |
|---|---|---|---|
| 225444 | 11/1959 | Australia | 52/306 |
| 508523 | 10/1952 | Belgium | 52/306 |
| 833753 | 4/1960 | United Kingdom | 52/306 |

*Primary Examiner*—Henry F. Epstein

[57] ABSTRACT

A hollow structural glass block is slotted by cutting or grinding to allow the installation of a specifically sized decorative panel insert into the interior of the block. The decorative insert is preferably comprised of stained, iridescent, or etched glass. A bead of clear silicone rubber caulking is applied to the bottom edge of the insert prior to slipping the insert through the slot. The silicone rubber caulking functions as an adhesive to secure the bottom edge of the insert stationary to the bottom interior of the block. The top edge of the insert is positioned between the edges of the block defining the slot. The slot, and the top exposed edge of the insert lying therein is covered with a layer of clear silicone rubber to secure the insert and seal the interior of the glass block against the entrance of moisture and mortar. Additionally, substantial thermal insulating values are maintained in the decorative blocks due to the sealed nature when completed. The decorative glass block may be installed with mortar in the same manner as conventional glass blocks to create colorful windows or partitions.

10 Claims, 4 Drawing Sheets

DECORATIVE GLASS BLOCK

BACKGROUND OF THE INVENTION

1. Field of the Invention

This invention relates to hollow structural glass blocks of the type commonly used in buildings for exterior windows and interior partitions and windows. The invention includes a simple method of adding a decorative panel insert into the interior of a previously manufactured and sealed glass block.

2. Description of the Prior Art

Structural glass blocks have been used in the past for building windows and partitions, and are installed with mortar in a well known manner similar to that used for bricks. Structural glass blocks are available in both translucent or almost clear glass, and are normally about four inches thick, by eight inches wide and eight inches high in size. Due to the relatively small size of structural glass blocks, normally a number of the blocks are utilized to form a single window or partition.

Commonly, each block is formed in two separate halves and then permanently attached together using heat fusion to form a completed hollow yet sealed block at the manufacturing plant. The vast majority of these blocks are formed with exterior front and back surfaces having an uneven or textured surface to provide a transparent but distorted, hence translucent, view through the block. This allows light to pass through the glass block, yet distorts shapes sufficiently to provide privacy.

SUMMARY OF THE INVENTION

We have provided an improved, potentially highly decorative structural glass block having a permanently affixed interior decorative panel insert, and a simple and effective method of placing and affixing the insert within the glass block. Our method of inserting the decorative insert into the glass block is especially well suited for small scale business operations such as art glass studios which do not have facilities to manufacture the glass blocks, but may purchase them from glass block manufacturers without the decorative insert installed.

With our method, the top center of a conventionally structured glass block is cut with a suitable cutting blade or disc to mechanically remove glass in order to provide a slot extending from the top of one vertical sidewall of the glass block to the opposite vertical sidewall, allowing access to the hollow interior. A properly sized decorative insert, preferably of art glass such as stained glass, iridescent art glass, etched glass, a stained glass leaded panel, or even a plastic panel insert may then be inserted vertically into the block through the slot. The use of a translucent glass or plastic insert allows for the passage of light through the block as usual, although it is conceivable that a decorative insert made impervious to light could possibly be used if desired. Prior to insertion of the decorative insert into the interior of the glass block, the bottom edge of the insert is covered with a bead of clear or transparent sealant or caulking, such as silicone rubber caulking, to secure the bottom edge from movement. A clear adhesive such as clear silicone rubber caulking is preferred since it will not show through the glass block, is readily available, and is thick enough when liquid to remain in place on the bottom edge of the decorative insert without dripping off during installation of the insert into the glass block. Other colors of caulking will of course also work.

With the insert installed, the vertical side edges of the insert would be positioned adjacent the interior surfaces of the sidewalls of the glass block, with the bottom edge of the insert adhered to the interior bottom surface of the glass block, and the top edge of the insert positioned and supported between the lengthwise edges of the block which define the newly formed slot. The slot in the glass block, and the top exposed edge of the decorative insert is then covered with a layer of clear silicone rubber caulking, to secure the top edge of the insert and seal the interior of the glass block against the entrance of moisture and mortar. The glass block can then be installed with mortar in the same manner as conventional glass blocks to create colorful or decorative windows and partitions.

Additionally, substantial thermal and sound insulating values are maintained in our decorative glass blocks due to the sealed nature of the hollow structure after completion of the installation of the insert.

A wide variety of potentially aesthetically pleasing designs and effects can easily and inexpensively be created with glass blocks using our simple method of installing a decorative insert. A window or wall divider such as for a bath shower stall can be provided to appear in one color, the color being determined by the color of the decorative insert, or a specific design or pattern can be created with glass blocks having different colored inserts therein. The insert itself can also include designs or patterns such as leaves, flowers or geometric forms which, when assembled with a number of similar glass blocks, forms a mosaic type effect.

BEST MODE FOR CARRYING OUT THE INVENTION

Figure 1:
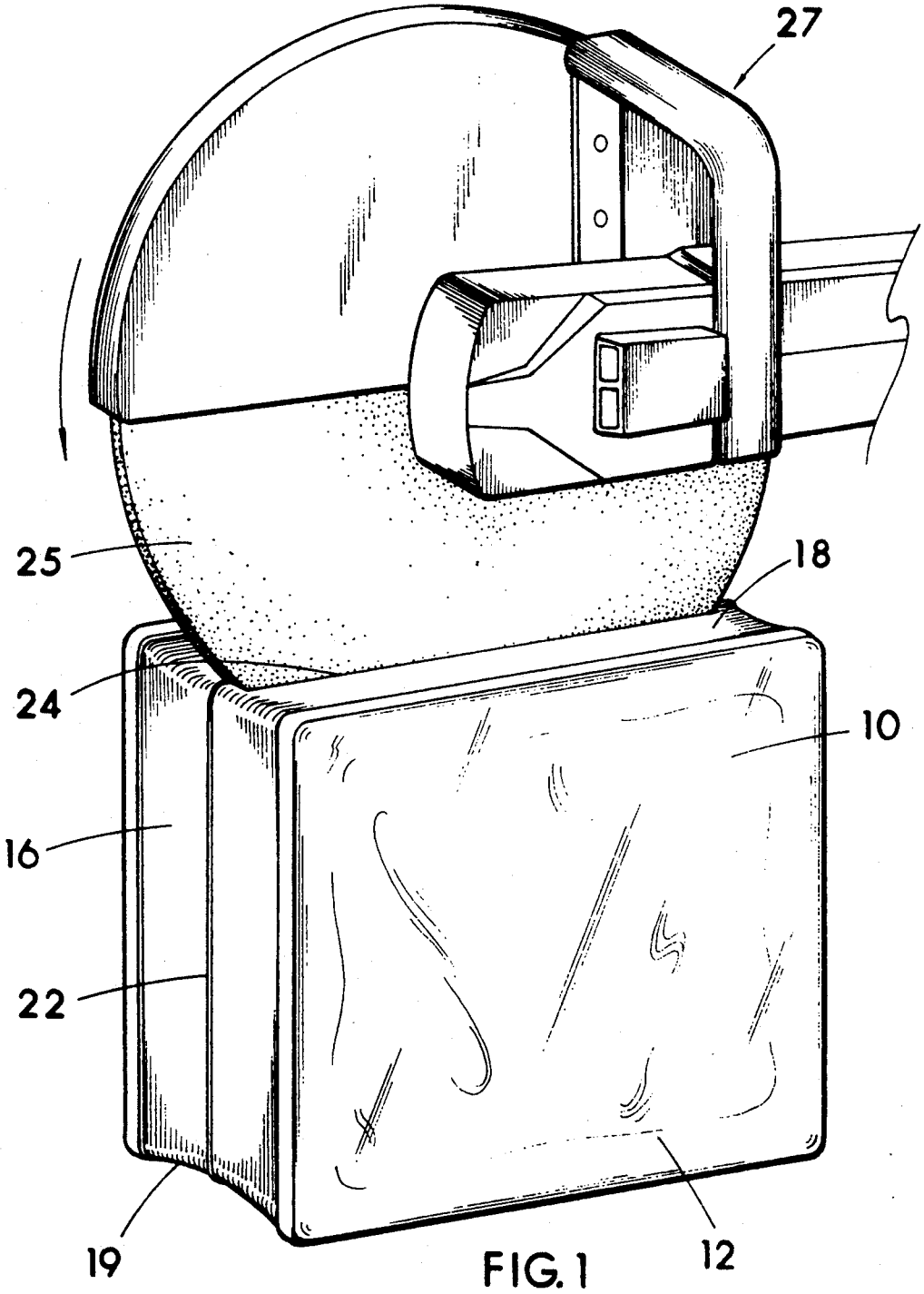
FIG. 1 is a top perspective view of a conventional structural glass block in the process of having a slot cut therein.

Referring now to the drawings in general, and particulary to FIG. 1 where a conventionally structured glass block 10 is shown. Glass block 10 is a rectangular, translucent block made of glass having a front panel or surface 12 oppositely disposed from a back panel or surface 14, two oppositely disposed sidewalls 16 and a top wall 18 oppositely disposed from a bottom wall 20. The walls and surfaces of block 10 define a hollow sealed interior chamber 21. Front and back surface 12 and 14 each normally extend outward beyond sidewalls 16 and top and bottom walls 18 and 20 so as to provide a slight recess 19 encircling block 10. The recess 19 allows placement of block 10 in wet mortar, wherein the mortar fills recess 19, and when the mortar hardens, block 10 is essentially locked in place. Additionally, the two sidewalls 16 and top and bottom walls 18 and 20 are often painted white in the area of recess 19 so as to hide dark mortar within recess 19 from being seen through the block 10, and to assist in reflecting more light through the block 10.

Front and back surface 12 and 14 normally have an irregular surface which distorts viewing through glass block 10. Glass block 10 is normally originally created in two separate halves which are permanently sealed together along a peripheral seam 22, which is centrally positioned in sidewalls 16 and top and bottom walls 18 and 20.

In order to install a decorative insert 26 in accordance with the immediate invention, an elongated narrow slot 24 must be formed in block 10 to access chamber 21. A simple process to form slot 24 is to mechanically remove some of the glass of block 10 with a circular cutting disk 25 driven by a power saw 27. Cutting disk 25 may be a diamond impregnated blade of the type often used for sawing rock. Other types of cutting disks 25 may be suitable which do not include diamonds. Power saw 27 may be what is commonly referred to as a cutoff saw, although a variety of power saws such as miter, table, hand-held circular saws, and chop saws will work with proper cutting blades or disks 25.

As shown in FIG. 1, a power saw 27, of which only a portion is shown, is being used to mechanically remove glass with cutting disk 25 from block 10 to form slot 24 and to access chamber 21. The desired width and thickness of decorative insert 26 will generally determine the size of slot 24. Slot 24 is cut generally commensurate in size to decorative insert 26, although sufficient clearance between slot 24 and insert 26 must be provided to allow the insertion of decorative insert through slot 24 and into chamber 21 of block 10. In FIG. 1, cutting disk 25 is shown cutting a slot 24 in what has been previously designated top wall 18 of block 10. The center seam 22 of block 10 may under some conditions be advantageously used as a guide for cutting disk 25. Slot 24 would be normally formed in the general center between front surface 12 and back surface 14 within recess 19 so as to allow insertion of decorative insert 26 into chamber 21 wherein the insert 26 lies with its wide front surface 28 and back surface 30 facing the front and back surfaces 12 and 16 of block 10. This placement of slot 24 within recess 19 also ultimately allows covering of slot 24 with mortar to hide it.

Figure 2:
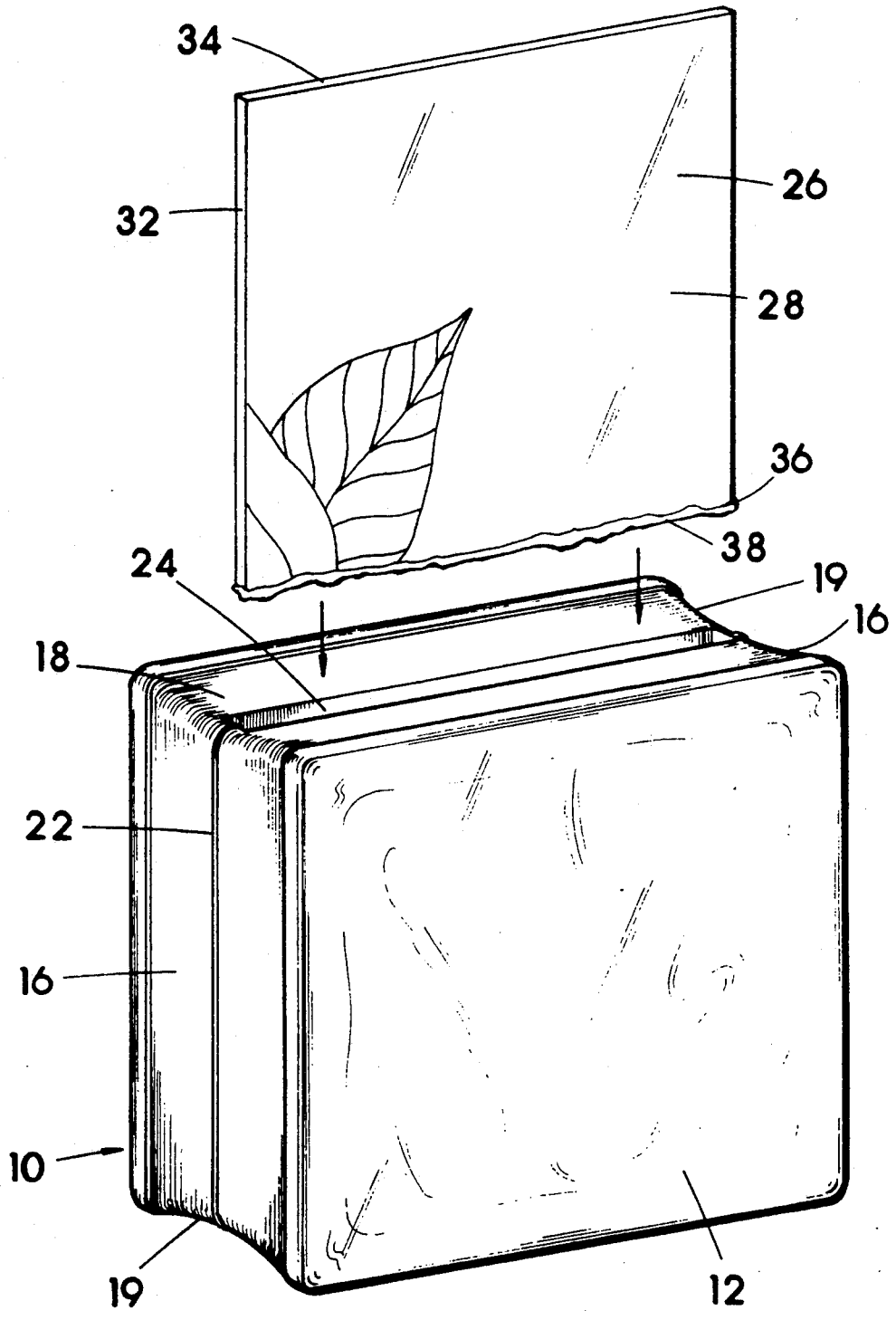
FIG. 2 is a top perspective view of the structural glass block showing a glass panel insert positioned over the slot and ready for installation.

Most often slot 24 will extend completely across top 18, extending from one sidewall 16 to the other sidewall 16 of block 10 as shown in FIG. 2, to allow the insertion of a decorative insert 26 sized to about the maximum width determined by the interior width of chamber 21. Additionally, there is no real disadvantage if slot 24 is slightly wider or longer than decorative insert 26, for instance, if only a narrow width decorative insert 26 is used in some glass blocks 10, while full width decorative inserts 26 are used in other glass blocks 10, it may be easier to cut slots 24 in all of the blocks 10 the full width of the blocks 10.

Decorative insert 26 is a flat transparent, translucent, or opaque panel, preferably glass and rectangular in shape. Decorative insert 26 could be made of plastic. Decorative insert 26 is cut or otherwise sized for insertion through slot 24 and into chamber 21 of glass block 10. Decorative insert 26 has a front surface 28, a back surface 30, two side edges 32, a top edge 34 and a bottom edge 36. The proper size of decorative insert 26 is such that the insert 26 is at least sized to fit through slot 24 and to span between the bottom interior surface of glass block 10 and the edges of glass block 10 which define slot 24, or in other words, the bottom edge 36 of insert 26 should be able to rest on the interior surface of bottom wall 20, with the top edge 34 of insert 26 resting within slot 24 in top wall 18 of block 10.

Figure 3:
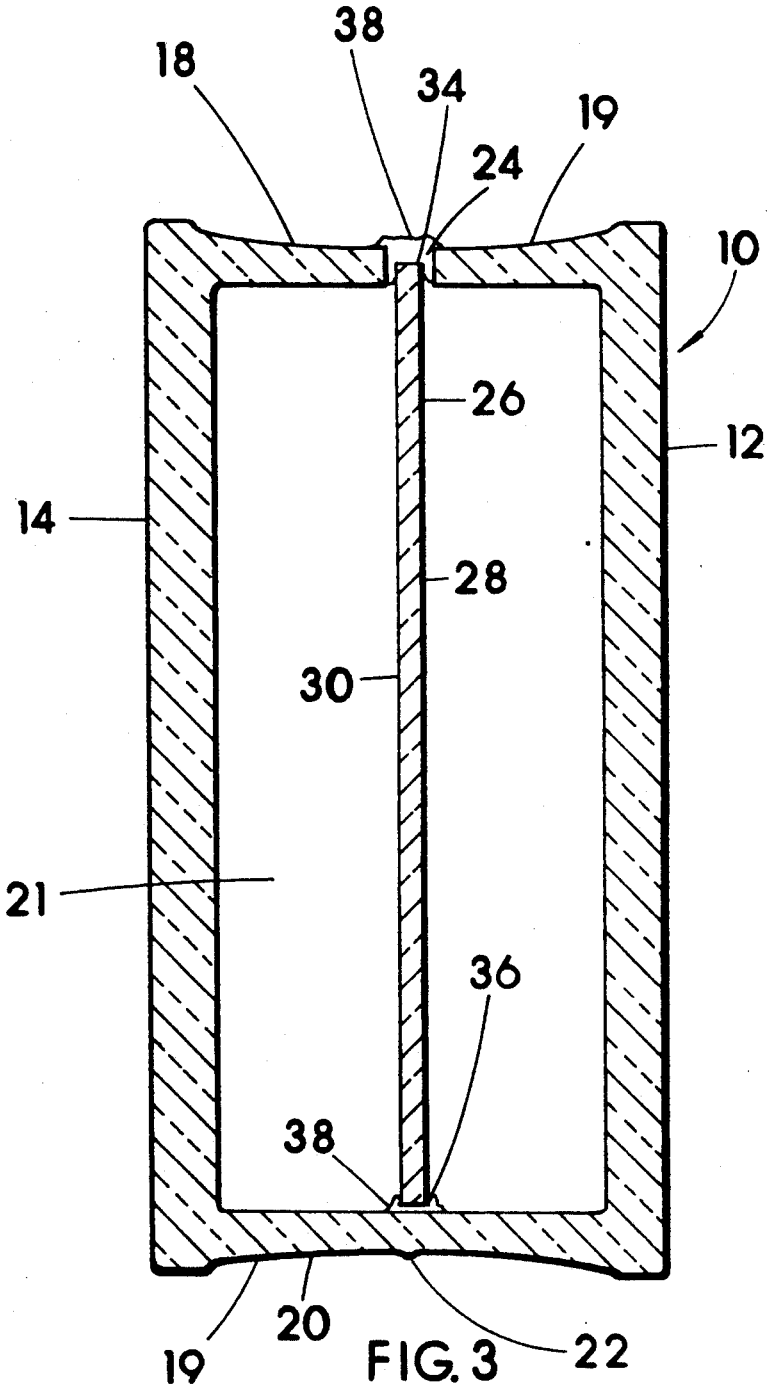
FIG. 3 is a cross sectional side view of the glass block with the insert installed therein, illustrating securement of the insert at the top and bottom edges.
Figure 4:
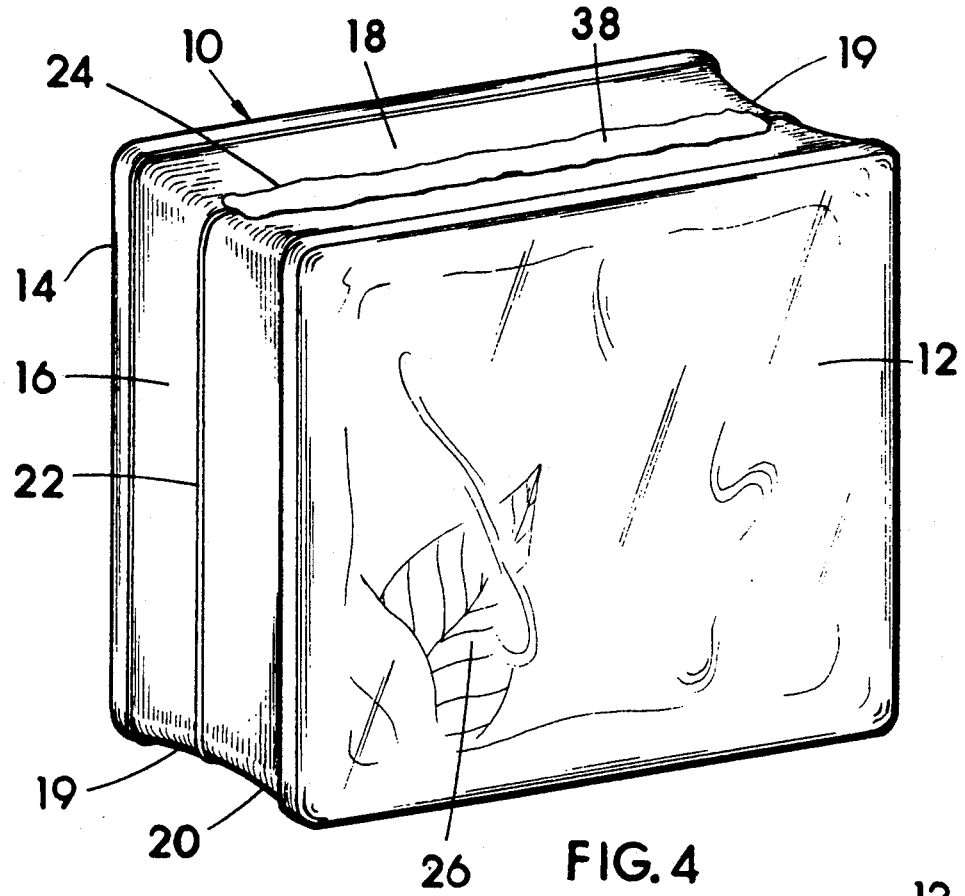
FIG. 4 is a top perspective view of the assembled glass block with the insert installed.

Prior to insertion of a properly sized decorative insert 26 into the interior of glass block 10, the bottom edge 36 of the insert 26 is covered with a bead of clear or transparent sealant or caulking, such as silicone rubber caulking 38 as shown in FIG. 2. Once a bead of silicone rubber 38 has been applied to bottom edge 36, decorative insert 26 may be inserted through slot 24 with silicone rubber 38 and bottom edge 36 first through slot 24. Decorative insert 26 is inserted into chamber 21 sufficiently to bring the bead of silicone rubber 38 into contact with the interior surface of bottom wall 20 of glass block 10. Next, silicone rubber 38 is applied between top or upper edge 34 of decorative insert 26 and at least one adjacent edge of glass block 10 which defines slot 24 as shown in FIG. 3. Silicone rubber 38 should then be applied over all of slot 24 so as to seal chamber 21 of glass block 10 against the entrance of moisture and mortar as shown in FIG. 4. Silicone rubber 38, which in this application is being used as both a sealant and an adhesive or glue, should have certain qualities such as a resistance to wide temperature fluctuations, good adherence to glass, be moisture impervious, and be unaffected by the chemicals in mortar 42, qualities which are common to most readily available silicone rubber caulkings sold in squeeze tubes.

Figure 5:
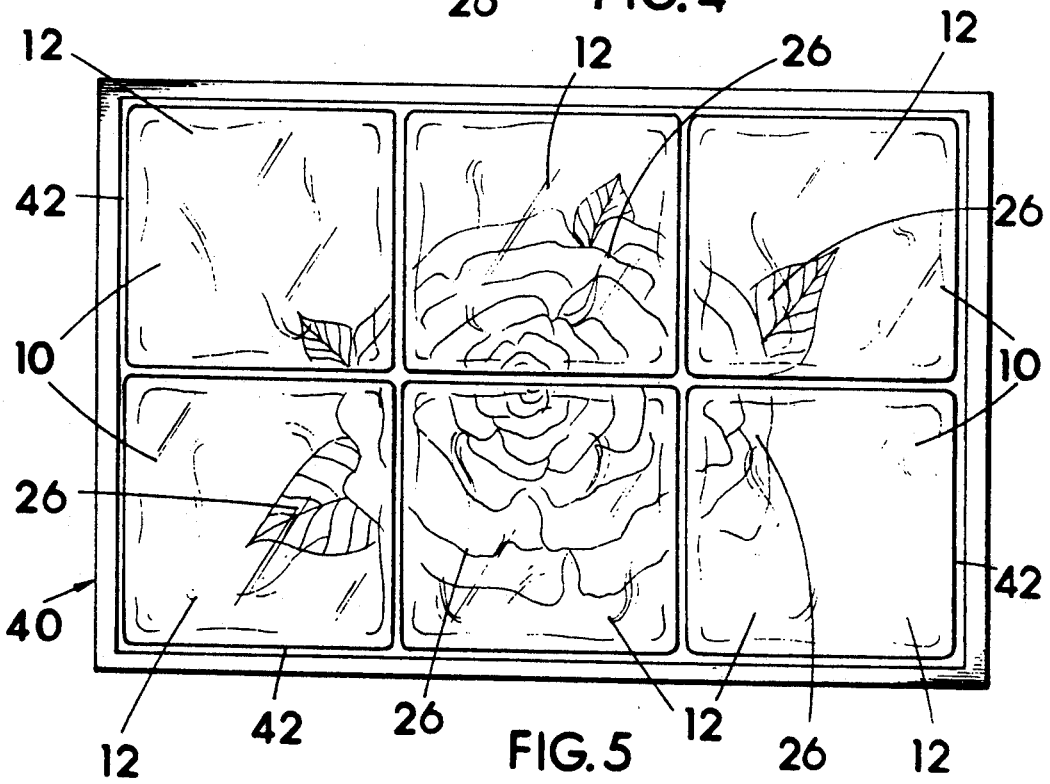
FIG. 5 illustrates several glass blocks with inserts installed in a window, providing a mosaic flower design.

Once silicone rubber 38 has sufficiently set, decorative insert 26 will be secured and the top and bottom edges to glass block 10, and block 10 will be completely sealed and ready for installation with mortar 42. A plurality of glass blocks 10 containing decorative inserts 26 can be utilized in the same manner as conventional structural glass blocks with mortar 42 to provide windows 40, as shown in FIG. 5, or divider walls, shower stall walls, and other structural uses.

It should be noted that although the securement of decorative insert 26 at both its top and bottom edges to glass block 10 is preferred for structural strength, the securement of the insert 26 at only its top edge lying within slot 24 has been found to also work relatively well.

Although we have very specifically described the best mode of carrying out the invention, it should be understood that the specific details are given for example to those skilled in the art. Minor changes may obviously be made without departing from the scope of the invention, and therefore it should be understood that the scope of the invention is not to be limited by the specification and drawings given for example, but should be determined by the broadest reasonable interpretation of our claims.

What we claim as our invention is:

1. A method of installing a decorative insert into a hollow, sealed glass block comprising the steps of:

mechanically removing a portion of glass of said glass block to form an elongated slot into the hollow interior of said glass block, applying adhesive to a bottom edge of a decorative insert, said decorative insert being at least sized to fit through said slot and to span between a bottom interior surface of said glass block and edges of said glass block defining said slot, inserting said decorative insert with said adhesive and said bottom edge first through said slot and bringing said adhesive into contact with the bottom interior surface of said glass block, applying adhesive between an upper edge of said decorative insert and at least one adjacent edge of said glass block defining said slot, applying adhesive over said slot so as to generally seal said slot.

2. A method according to claim 1 further including utilizing silicone rubber caulking as said adhesive.

3. A method according to claim 2 further including utilizing clear said silicone rubber caulking as said adhesive.

4. A method according to claim 3 further including utilizing a decorative insert made of glass.

5. A method according to claim 4 further including utilizing a rotary cutting wheel for mechanically removing glass to form said slot in said glass block.

6. A method of installing a decorative insert into a hollow, sealed glass block comprising the steps of:

mechanically removing a portion of glass of said glass block to form an elongated slot into the hollow interior of said glass block, inserting a decorative insert through said slot, said decorative insert being at least sized to fit through said slot and to span between a bottom interior surface of said glass block and edges of said glass block defining said slot, applying adhesive between an upper edge of said decorative insert and at least one adjacent edge of said glass block defining said slot, applying adhesive over said slot so as to generally seal said slot.

7. A method according to claim 6 further including utilizing silicone rubber caulking as said adhesive.

8. A method according to claim 7 further including utilizing clear said silicone rubber caulking as said adhesive.

9. A method according to claim 8 further including utilizing a decorative insert made of glass.

10. A method according to claim 9 further including utilizing a rotary cutting wheel for mechanically removing glass to form said slot in said glass block.

* * * * *